US006081284A

United States Patent [19]

Tosaka et al.

[11] Patent Number: 6,081,284

[45] Date of Patent: Jun. 27, 2000

[54] RECORDING APPARATUS WITH PLURAL INK TANK CONFIGURATIONS

[75] Inventors: Yoichi Tosaka; Kenichiro Hashimoto, both of Yokohama, Japan

[73] Assignee: Canon Kabushiki Kaisha, Tokyo, Japan

[21] Appl. No.: 08/410,679

[22] Filed: Mar. 27, 1995

[30] Foreign Application Priority Data

| | | | |
|---|---|---|---|
| Mar. 30, 1994 | [JP] | Japan | 6-084024 |
| Mar. 3, 1995 | [JP] | Japan | 7-070648 |

[51] Int. Cl.[7] ..... B41J 2/175

[52] U.S. Cl. ..... 347/87

[58] Field of Search ..... 347/84–87

[56] References Cited

U.S. PATENT DOCUMENTS

| | | | |
|---|---|---|---|
| 4,313,124 | 1/1982 | Hara | 347/57 |
| 4,320,406 | 3/1982 | Heinzl | 347/43 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,771,295 | 9/1988 | Baker et al. | 347/87 |
| 4,855,762 | 8/1989 | Suzuki | 347/86 |
| 5,199,470 | 4/1993 | Goldman | 141/1 |

FOREIGN PATENT DOCUMENTS

| | | | |
|---|---|---|---|
| 322131 | 6/1989 | European Pat. Off. . | |
| 567308 | 10/1993 | European Pat. Off. . | |
| 639462 | 2/1995 | European Pat. Off. . | |
| 639462-A2 | 2/1995 | European Pat. Off. | 347/86 |
| 3401071 | 7/1985 | Germany . | |
| 3424175 | 1/1986 | Germany . | |
| 59-123670 | 7/1984 | Japan . | |
| 59-138461 | 8/1984 | Japan . | |
| 63-87242 | 4/1988 | Japan . | |
| 1-12675 | 3/1989 | Japan . | |
| 1-242256 | 9/1989 | Japan . | |
| 6-106729 | 4/1994 | Japan | 347/85 |

*Primary Examiner*—N. Le
*Assistant Examiner*—Judy Nguyen
*Attorney, Agent, or Firm*—Fitzpatrick, Cella, Harper & Scinto

[57] ABSTRACT

An ink jet recording apparatus for recording by discharging ink from a plurality of recording means to a recording material comprises a plurality of ink paths which are communicated with the recording means and an exchangeable ink tank for retaining ink to be discharged. The ink paths are arranged in a given number corresponding to the number of the recording means, and further, the end portion on the ink tank side is arranged in a position facing one or plural ink supply ports of a first ink tank having ink retaining units to supply ink to such a given number of recording means. This apparatus also comprise a second ink tank having ink retaining units in a number smaller than the aforesaid given number. Here, the second ink tank is provided with means for sealing at least one end portion of the aforesaid ink paths on the ink tank side, which supply ink having colors different from that of the ink contained in the second ink tank. With such structure, an ink jet recording apparatus can install an ink tank whose capacity is larger for a specific ink without making the apparatus larger, and also, prevent ink from being dried in the ink paths where no ink tank is installed.

19 Claims, 7 Drawing Sheets

RECORDING APPARATUS WITH PLURAL INK TANK CONFIGURATIONS

BACKGROUND OF THE INVENTION

1. Field of the Invention

The present invention relates to an ink jet recording apparatus for recording by discharging ink from recording means to a recording medium, and an ink tank used for the ink jet recording apparatus. More particularly, the invention relates to an ink jet recording apparatus for recording in plural colors, and an ink tank used for such ink jet recording apparatus.

2. Related Background Art

A recording apparatus provided with the function of a printer, copying machine, facsimile or the like or a recording apparatus used as an output equipment for a complex machine including a computer, a wordprocessor, and the like or a work station, is structured to record images (including characters, symbols, and others) on a recording material (recording medium) such as a sheet or a thin plastic board (OHP or the like). Such recording apparatuses can be divided into those of an ink jet type, wire-dot type, thermo-sensitive type, thermo-transfer type, laser beam type, and others according to the recording type of recording means adopted by each of them.

In a recording apparatus of a serial type, which adopts a recording method where its main scan is performed in the direction intersecting the feeding direction of a recording material (that is, the subscanning direction), images (including characters, symbols, and others) are recorded by recording means mounted on a carriage movable along the recording material (that is, the main scanning) after a recording material is set at a given recording position. Then, after the completion of recording one line of an image, the sheet is fed (subscanned) for a given amount in order to record the next line of the image (main scanning). By repeating this operation, the image is recorded in a desired area of the recording material.

On the other hand, in a recording apparatus of a line type whose recording is executed only by subscanning where the recording material is fed, a recording material is set at a given recording position, and then, a sheet feeding is performed for a given amount (in a pitch feeding mode) while one line is recorded continuously altogether; hence recording images on the entire area of the recording material.

Of these types, those of an ink jet type (ink jet recording apparatuses) are to record by discharging ink from recording means (recording head) to a recording material to make it possible to provide compact recording means with ease for recording highly precise images at high speeds. With this type, it is also possible to record on an ordinary sheet without any particular treatments, hence at a lower running cost. Moreover, being non-impact, this type makes less noises besides a remarkable advantage that many different colors of ink can be used for recording images in colors without difficulty. Particularly, in a recording apparatus of a line type using a line type recording means in which many numbers of discharge ports are arranged in the width direction of a sheet, it is possible to implement the provision of a higher speed recording.

Especially, recording means (recording head) of an ink jet type which discharges ink by utilizing thermal energy can be easily processed to provide the recording means in which liquid paths (discharge ports) are arranged in a high density by the film formation of electrothermal transducing elements, electrodes, walls of liquid paths, and a ceiling on a base board through etching, deposition, sputtering, and some other semiconductor processing steps. This contributes significantly to attaining the manufacture of more compact recording means.

Also, with the utilization of such known advantages of the IC technologies and micro machining techniques, it becomes easier to elongate the recording means or effectuate its surfacing (two-dimensional arrangement) as well as to make the recording means fully multiple and highly densified when it is assembled.

This ink jet recording apparatus comprises recording means formed by discharge port groups, ink droplet generating mechanism, and others; ink paths for conducting ink to the recording means; and ink retaining means (ink tank) for retaining ink to be supplied to the recording means through the ink paths.

An ink jet type of the kind is often adopted for use of a recording apparatus whose recording mode is not only such as using a single type of ink, but also, using plural kinds of ink having different densities (concentrations) and colors so that tonal images or color images can be recorded by conducting such kinds of ink to given discharge ports for discharging as required. Now, given below, the description will be made of a structural example (type) representing the apparatus for which plural kinds of ink are used.

As a first type, there can be named the one in which recording means, ink paths, and ink tank are integrated as a unit per ink to be used, and installed on one base member (a carriage of a serial recording apparatus, for example).

Then, as a second type, there can be named the one in which a unit, which is provided with the recording means, ink paths, and ink tank integrally formed, is installed on a carriage for discharging three colors—yellow, magenta, and cyan (hereinafter abbreviated as Y, M, and C)—such as disclosed in Japanese Patent Laid-Open Application No. 63-87242. In this type, while a recording is performed in colors, Y, M, and C are overlaid for printing in black as required.

Also, as a third type, there can be named the one in which recording means, having the Y, M, and C units of the second type described above, is fixed to a carriage, but an arrangement is made so that the ink tank can be attached to or detached from the carriage instead of the recording means as disclosed in Japanese Patent Publication No. 1-12675.

In accordance with the conventional examples described above, however, there are disadvantages that even when only a specific kind of ink is used, the amount of usable ink is kept at the same level as that of ink used at the time of entire ink tanks being installed or that even if the larger amount of ink can be arranged for supplying a specific color, it costs inevitably more to make such specific provision possible.

Here, more precisely, to begin with the first type described above. Since a unit is provided for each ink in this type, it is possible to increase the capacity of a tank for a specific ink, black, for example. However, if a particular unit should be made larger than the other units to meet this requirement, there is a need for a space arranged to be large enough in the height direction just to match one tank whose capacity is increased, because the plural units are arranged in line for use. Accordingly, an ink jet recording apparatus should be made larger in size to adopt the first type described above.

Also, in the second type described above, each ink of Y, M, and C must be overlaid for printing in black, thus requiring a considerable amount of ink for each color. In this case, therefore, if its use is often confined to printing in black, it should be more advantageous to arrange the selective installation of a unit which is provided integrally with recording means, ink paths, and ink tank formed for the dedicated use of Bk ink. The reason is that the amount of ink for the dedicated Bk unit is substantially equal to the combined amount of three ink colors of Y, M, and C units, and that by use of one specific unit, more recording is possible, leading to the enhanced volumetric efficiency.

However, this brings about disadvantages in terms of cost performance because recording means should also be made exchangeable just for using Bk and other colors separately, while the recording means itself is already an expensive component of an ink jet recording apparatus.

Also, in regard to the printing in Bk while executing color recording, if an integrated unit of four colors, Y, M, C, and Bk, is adopted to execute printing only by use of Bk ink instead of the mode in which printing in black is performed by overlaying Y, M, and C ink, the overall efficiency of ink usage or the volumetric efficiency is still lowered eventually.

Further, in the third type described above, the ink tanks are arranged to be exchangeable. It is possible to use ink tanks having different capacities with ease at a lower cost. However, if a large ink tank should be installed, the recording apparatus should also be arranged in a larger size accordingly. In this aspect, the third one is the same as the first type described above. Also, there may be encountered a drawback that if only a specific ink tank is installed, the remaining ink having its specific properties may be dried and solidified in the ink paths where the other ink tank should be installed for using ink of different properties.

SUMMARY OF THE INVENTION

The present invention is designed in consideration of the technical problems described above. It is an object of the invention to provide an ink jet recording apparatus capable of installing an ink tank having a large capacity for a specific ink without making the apparatus larger, and also, capable of preventing ink from being dried in the ink paths where no ink tank is installed.

In accordance with the present invention, an ink jet recording apparatus for recording by discharging ink from a plurality of recording means to a recording material comprises a plurality of ink paths which are communicated with the recording means and an exchangeable ink tank for retaining ink to be discharged. The ink paths are arranged in a given number corresponding to the number of the recording means, and further, the end portion on the ink tank side is arranged in a position facing one or plural ink supply ports of a first ink tank having ink retaining units to supply ink to such a given number of recording means. This apparatus comprise a second ink tank having ink retaining units in a number smaller than the aforesaid given number. Here, the second ink tank is provided with means for sealing at least one end portion of the aforesaid ink paths on the ink tank side, which supply ink having colors different from that of the ink contained in the second ink tank.

The second ink tank can be arranged to provide the ink retaining unit whose volume is larger than that of the ink retaining unit of the first ink tank of the same color, and the aforesaid sealing means is a recess formed by an elastic member in the second ink tank of the ink jet recording apparatus.

The ink jet recording apparatus of the present invention is provided with recording means having the electrothermal transducing elements which generate thermal energy to be utilized for discharging ink. The aforesaid recording means discharge ink from its discharge ports by utilizing the film boiling created in ink by the application of the thermal energy generated by the electrothermal transducing elements.

It is another object of the present invention to provide an ink tank which is communicated with the ink paths for supplying ink to recording means of an ink jet recording apparatus capable of discharging a given number of plural kinds of ink. In accordance with the present invention, this ink tank comprises ink retaining units for fewer kinds of ink than such given number, and the sealing unit which seals the ink path at the same time when no ink tank is installed for it.

It is still another object of the present invention to provide an ink refilling system for an ink jet recording apparatus provided with recording means capable of discharging a given number of plural kinds of ink. In accordance with the present invention such refilling system comprises:

an ink tank communicated with the ink paths for supplying ink to the recording means of the aforesaid ink jet recording apparatus: this ink tank is provided with ink retaining units for fewer kinds of ink than the given number, and a sealing unit for sealing the ink paths at the same time; and an ink refilling device for refilling ink in the aforesaid ink tank: this ink refilling device comprises an ink retaining unit for retaining ink to be refilled, and ink induction means for inducing the aforesaid ink to the ink tank.

The ink induction means of the ink refilling system can be arranged to induce ink to the ink tank through the ink supply port provided for the ink tank to supply ink externally or through the ink refilling aperture which is provided for the ink tank.

With the structures as arranged above according to the present invention, it is possible to provide an ink jet recording apparatus capable of installing an ink tank whose capacity is larger for a specific ink without making the apparatus larger, and also, capable of preventing ink from being dried in the ink paths where no ink tank is installed.

DETAILED DESCRIPTION OF THE PREFERRED EMBODIMENTS

Hereinafter, with reference to the accompanying drawings, the description will be made of the embodiments according to the present invention. In this respect, the elements referred to by the same reference marks in each of the accompanying drawings are assumed to be one and the same or those having the same function.

Figure 1:
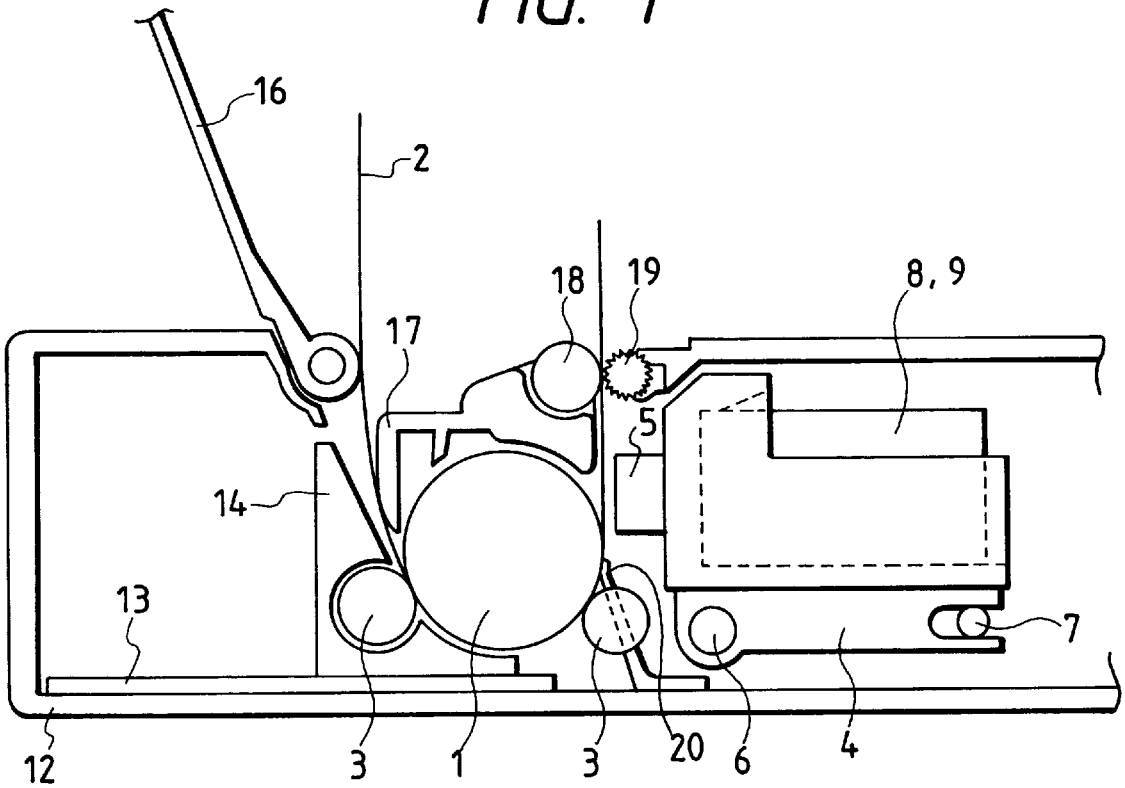
FIG. 1 is a vertically sectional view which schematically shows the entire structure of one embodiment of an ink jet recording apparatus to which the present invention is applicable.
Figure 2:
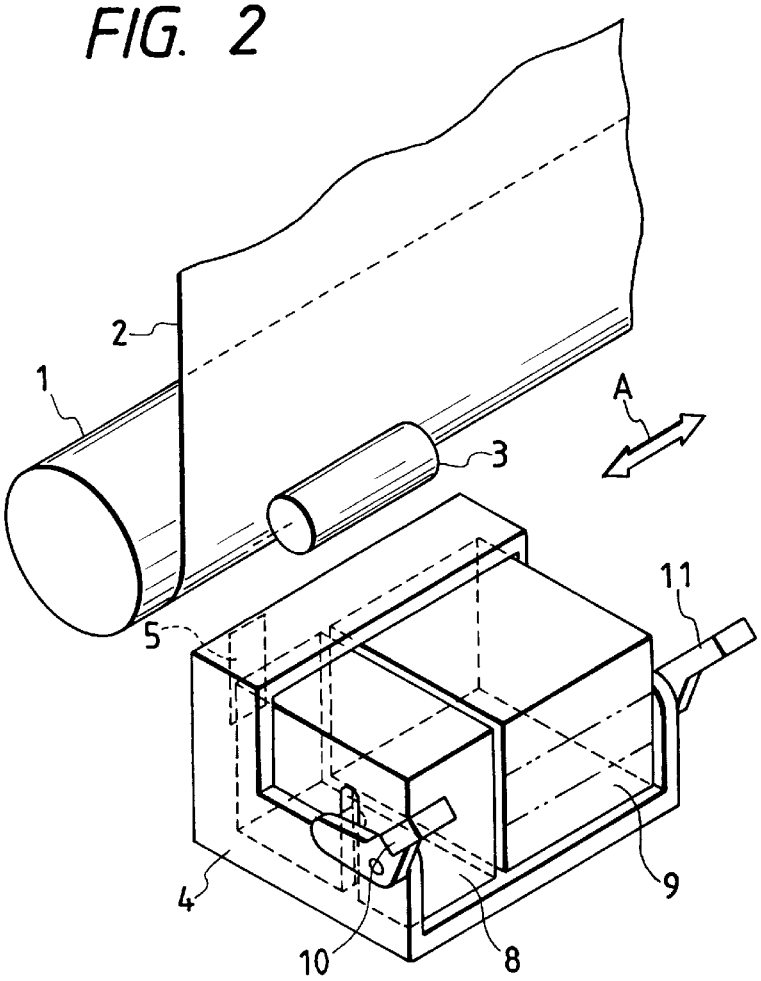
FIG. 2 is a perspective view which schematically shows the circumference of a carriage having recording means installed on it, and means for feeding a recording material, which faces the recording means as one embodiment of an ink jet recording apparatus to which the present invention is applicable.

FIG. 1 is a vertically sectional view which schematically shows the structure of one embodiment of an ink jet apparatus to which the present invention is applicable. FIG. 2 is a perspective view schematically showing the structure of principal parts of an ink jet recording apparatus according to one embodiment of the present invention.

In FIG. 1 and FIG. 2, a reference numeral 1 designates a feed roller (sheet feed roller). A recording material (recording medium) 2 such as a recording sheet is fed by a given amount each by the rotation of the feed roller 1. A reference numeral 3 designates a pinch roller which is pressed to the feed roller 2 by the application of biasing force of a spring or the like. This pinch roller 3 gives a friction force by pinching the recording material 2 elastically in cooperation with the feed roller 1 in order to exactly transform the rotation of the feed roller 1 into a sheet feeding force. A reference numeral 4 designates a carriage. On the carriage 4, a recording head unit 5 serving as recording means, and the ink paths which will be described later are integrally provided.

The carriage 4 is guided and supported to reciprocate in the direction indicated by arrows A (main scanning direction) along the guide rails 6 and 7 (see FIG. 1) arranged in parallel to the feed roller 1. On the carriage 4, an ink tank 8 for use of black ink, and an ink tank (ink tank unit) 9 for use of Y (yellow), M (magenta), and C (cyan) ink are installed exchangeable. The ink tank 9 for use of Y, M, and C ink is in a unit structure which is arranged by superposing the ink tanks of each color in three layers integrally as indicated by two-dot chain lines in FIG. 2.

Here, in the carriage 4, the rotational lock levers 10 and 11 are axially supported as shown in FIG. 2. In a state represented by FIG. 2, both ink tank 8 for use of black ink, and ink tank 9 for use of Y, M, and C ink are locked on the carriage 4, respectively.

Then, a reference numeral 12 designates an external member which forms the external appearance of the recording apparatus. On the inner side of the external member 12, a chassis 13 is fixed. To the chassis 13, a base 14, guide rails 6 and 7, and others are fixed. The base 14 forms a passage for the recording material 2. Also, on the base 14, the feed roller 1, pinch roller 3, and others are rotatively and axially supported.

A reference numeral 16 designates an exhaust sheet tray; 17, a platen fixed to the base 14; 18, an exhaust sheet roller which is axially and rotatively supported by the platen 17; 19 a spur which is axially and rotatively supported by the external member 12 so that it can be pressed to the exhaust roller 18; and 20, a sheet pressure member which serves to press the recording material 2 closely to the circumference of the feed roller 1 in a position immediately before the recording unit. The leading end of the sheet pressure member 20 is pressed elastically to the feed roller 1.

Also, in FIG. 1, there are arranged on the front face (discharge port surface) of the recording head unit 5, the discharge port groups for recording in different ink, respectively, that is, four discharge port groups, which perform the respective recording in Bk, Y, M, and C ink in the present embodiment, arranged dividedly in a given order in the direction of sheet feeding. In accordance with the present embodiment, these are arranged in order of Bk, Y, M, and C from the lower side (the upperstream side in the direction of sheet feeding).

Here, recording means (recording head unit) 5 is an ink jet recording means which discharges ink by utilizing thermal energy, having electrothermal transducing elements for generating the thermal energy. Also, the recording head unit 5 discharges ink from the discharge ports for recording by the utilization of pressure changes by the development and contraction of air bubbles caused by film boiling created by the application of thermal energy generated by the electrothermal transducing elements.

Figure 3:
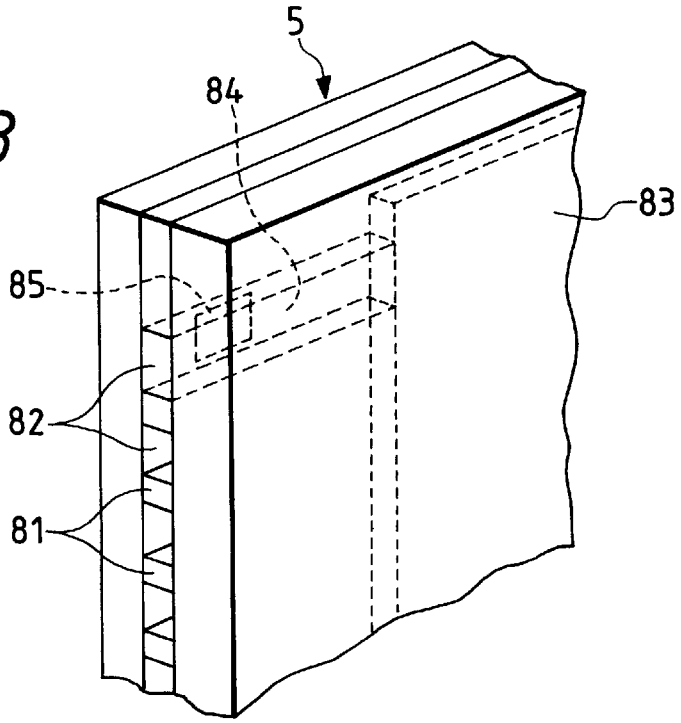
FIG. 3 is a partially perspective view which schematically shows the structure of the ink discharge unit of the recording means represented in FIG. 2.

FIG. 3 is a partially perspective view which schematically shows the structure of the ink discharge ports of the recording head 5. In FIG. 3, a plurality of discharge ports 82 are formed at given pitches per discharge port group on the discharge port surface 81 which faces the recording material (recording sheet or the like) 2 at a given interval (approximately 0.5 to 2.0 mm, for example). Along the wall face 84 of each liquid path which is communicated with a common liquid chamber 83 and each of the discharge ports 82, an electrothermal transducing element (heat generating resistive element or the like) 85 is arranged.

In the present embodiment, the recording head 5 is installed on the carriage 4 with such a positional relationship that a plurality of discharge ports 82 of each discharge port group are arranged in the direction intersecting the traveling direction (main scanning direction) of the carriage 4. In this way, the corresponding electrothermal transducing elements are driven (energized) in response to image signals or discharge signals to give film boiling to ink in the corresponding liquid path 84. Then, the structure of recording means 5 is arranged to discharge ink from the discharge ports 82 by the application of pressure thus generated at that time.

Figure 4:
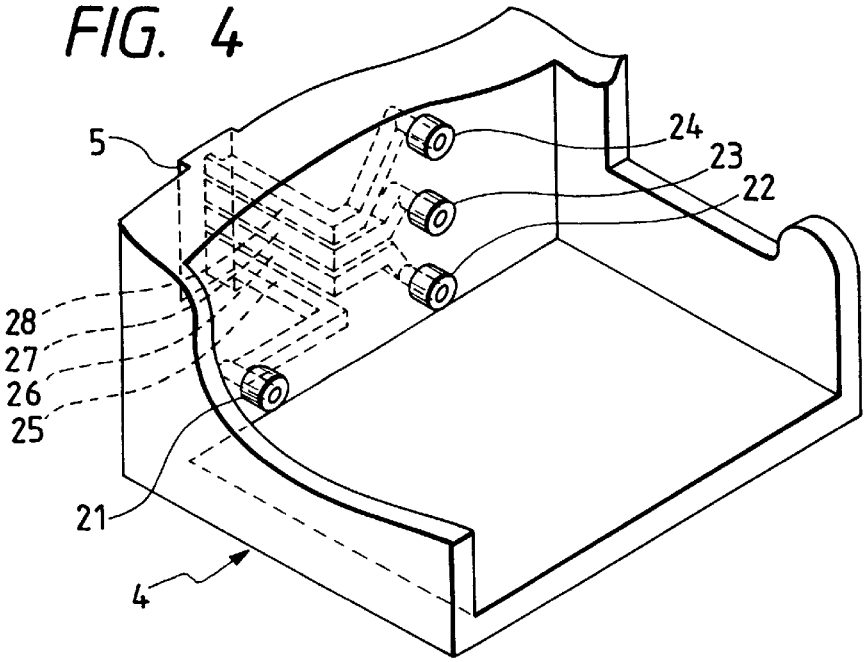
FIG. 4 is a partially broken perspective view which schematically shows the structure of the carriage represented in FIG. 2.

Now, the ink supply paths will be described. FIG. 4 is a partially broken perspective view which illustrates the carriage 4 represented in FIG. 2. In FIG. 4, there are arranged on the carriage 4 a joint unit 21 for the ink tank 8 for use of black ink, and joint units 22, 23, and 24 for the ink tank (ink tank unit) 9 for use of Y, M, and C ink. When the ink tanks are installed, these joint units 21, 22, 23, and 24 are allowed to be inserted (fitted) air-tightly into the ink tanks containing the corresponding ink.

This arrangement is made in order to avoid any ink leakage from the fitting portions when the ink tanks are installed, but if a fibrous bundling mechanism or the like is provided for each aperture on the ink tank side for ink leakage prevention, it may be possible to arrange these units simply with free joints.

Here, the joint units 21, 22, 23, and 24 are communicated with the corresponding discharge port groups of the recording head (unit) 5 through the ink paths 25, 26, 27, and 28, respectively. In this respect, each of the ink paths 25, 26, 27, and 28 is divided into a plurality of liquid paths (ink paths) 84 corresponding to a plurality of discharge ports 82 in the vicinity of the respective discharge port groups.

Further, although not particularly shown in FIG. 4, it is desirable to install filters on the end portions of the joint units 21, 22, 23, and 24 on the ink tank side in order to prevent dust particles or the like from entering ink paths when the ink tanks are removed, and also, to keep retaining ink reliably in the ink paths even in the state where no ink tanks are installed.

With the structure described above, each of Bk, Y, M, and C ink in the ink tank 8 for use of Bk, and ink tank 9 for use of Y, M, and C is supplied to the corresponding discharge port group (liquid path group) of the recording head unit 5 through each of the ink paths 25, 26, 27 and 28 in the carriage 4, while the carriage 4 is able to reciprocate in the directions indicated by arrows A along the guide rails 6 and 7.

In synchronism with the traveling (main scanning) of the carriage 4, and also, in accordance with image information, ink droplets are selectively discharged from each of the discharge ports of the respective discharge port groups, hence images are being recorded on a recording material 2. After one line is recorded, the recording material 2 is fed (subscanned) with the rotation of the feed roller 1 for a given amount to record the next line. Thereafter, a sheet feeding of the kind and recording are repeated to complete the intended recording on the desired area of the recording material 2. Then the recording material 2 is exhausted outside the apparatus by means of the aforesaid sheet exhaust roller 18 and spur 19 after the images are completely recorded.

Figure 5A:
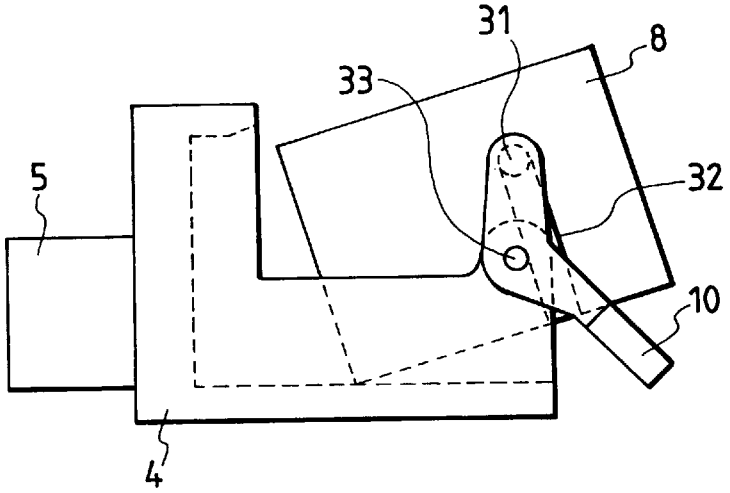
FIGS. 5A, 5B, and 5C are side views schematically showing the operational process in which an ink tank is being locked on a carriage.
Figure 5B:
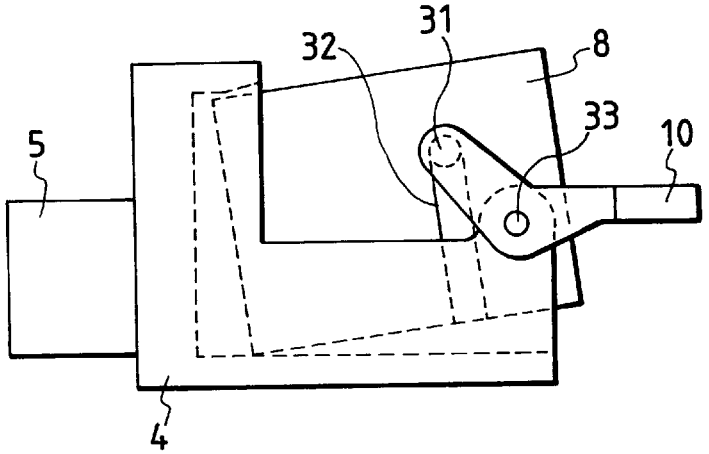
Figure 5C:
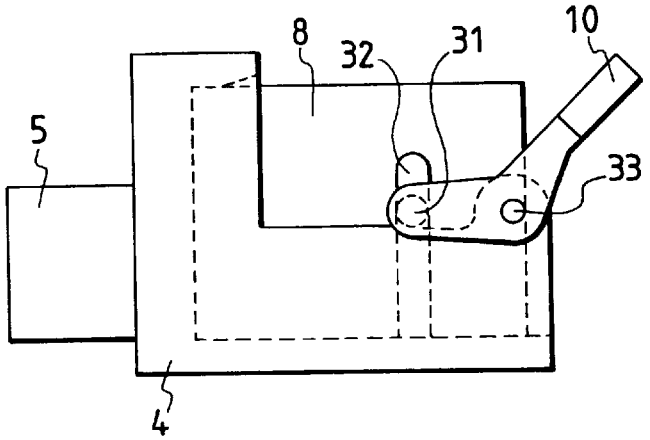

Hereinafter, the description will be made of an ink tank installation mechanism in accordance with the present embodiment. FIGS. 5A to 5C are side views which schematically illustrates the operation of locking the ink tanks 8 and 9 on the carriage 4 by use of the lock levers 10 and 11.

In this respect, the left and right lock levers 10 and 11, and the left and right ink tanks (the one for Bk use, and the one for Y, M, and C use) 8 and 9 are essentially of the same structure to operate in the same way. Hereunder, therefore, the lock lever on the left side will be described in detail, and the detailed description of the one on the right side will be omitted.

In FIGS. 5A to 5C, a dowel (extrusion) 31 is planted on the one end of the lock lever 10. In a state before the ink tank is installed, the lock lever 10 is turned extremely clockwise as shown in FIG. 5A. The lock lever 10 is supported to rotate around a shaft 33 arranged on the carriage 4.

On the other hand, an elongated groove 32 is formed on the side end of the ink tank 8. In the initial state, the ink tank 8 can be placed on the carriage 4 by fitting the dowel 31 of the lock lever 10 into this elongated groove 32 as shown in FIG. 5A.

After the dowel 31 is fitted into the elongated groove 32 as shown in FIG. 5A, the lock lever 10 is caused to rotate counterclockwise. Then the ink tank 8 is pressed in the left-hand direction in FIG. 5A by means of the dowel 31 and elongated groove 32 to enable it to shift on the carriage 4 in the left-hand direction, thus presenting a state as shown in FIG. 5B. When the lock lever 10 is further turned counterclockwise as shown in FIG. 5B, the ink tank is in a state as shown in FIG. 5C.

In the state represented in FIG. 5C, the ink tank 8 abuts almost upon the inner face of the front side of the carriage 4, that is, the surface where each of the ink tank joint units 21, 22, 23, and 24 are formed as shown in FIG. 4.

Also, the structure is arranged so that even if a force is exerted to cause the ink tank 8 to shift in the right-hand direction in FIG. 5C, the elongated groove 32 is in engagement with the dowel 31, and the force which acts upon the dowel 31 is oriented toward the rotational shaft (the center of rotation) 33 of the lock lever 10. Thus there is no possibility that the ink tank 8 is removed unexpectedly.

Here, in FIGS. 5A to 5C, the outline of the processes of installing the ink tank 8 is described while observing it in the direction from the side face of the ink tank (Bk use) 8. The processes of installing the other ink tank (Y, M, and C use) 9 by means of the other lock lever 11 are essentially the same as above. Therefore, its description will be omitted.

Figure 6:
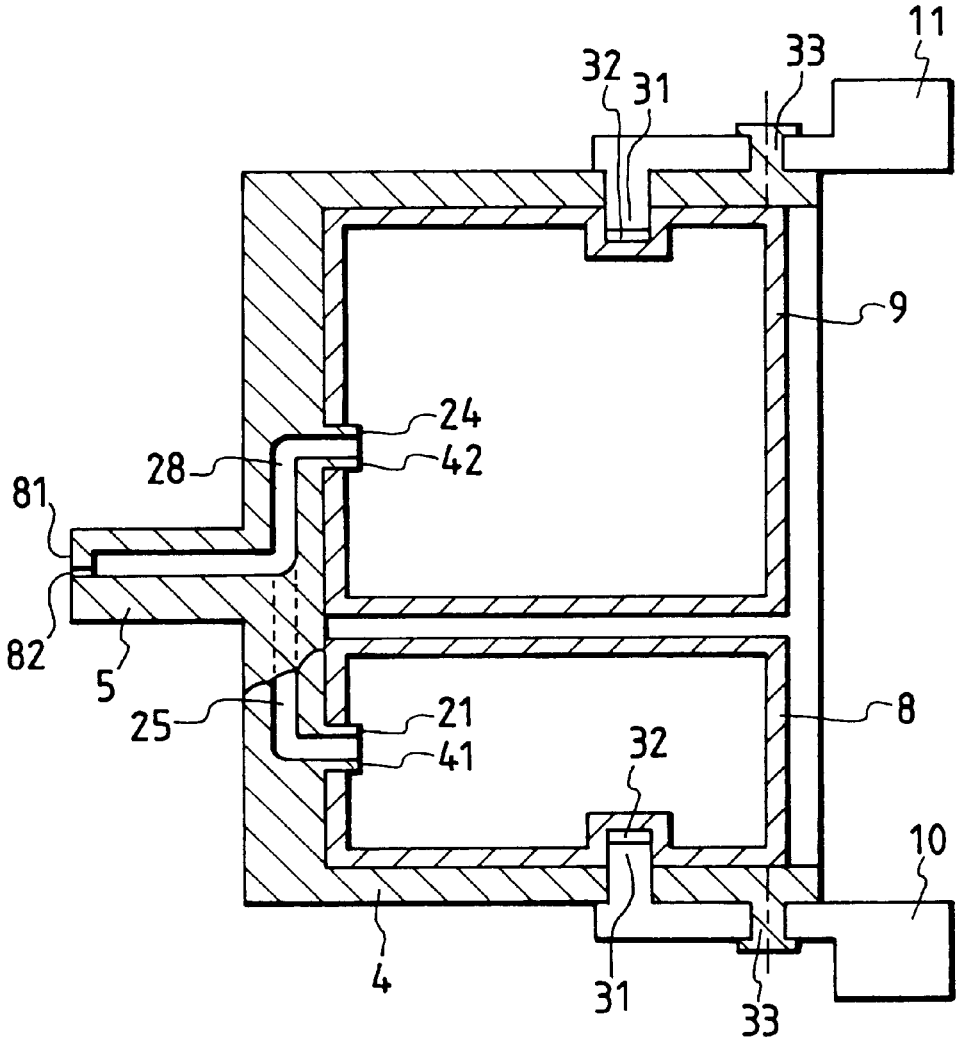
FIG. 6 is a horizontally sectional view which schematically shows the horizontal cross-section of the carriage and ink tank represented in FIG. 2.

Now, the description will be made of the ink supply system at the time of installing the ink tanks. FIG. 6 is a horizontally sectional view schematically illustrating the carriage 4 and ink tanks 8 and 9 represented in FIG. 2. Here, apertures 41 and 42 are an ink supply aperture (ink supply port) arranged for the Bk ink tank, and an ink supply port arranged for the C ink retaining unit of the color ink tank, respectively. Further, although not shown in FIG. 6, a porous element or some other ink absorbent is arranged in each of the ink tanks to hold ink and generate a negative pressure for preventing ink leakage from the discharge port groups of the recording head.

In the state represented in FIG. 6, the joint 21 for Bk use is inserted into the ink tank 8 on the carriage 4, and is fitted air-tightly with the ink supply port 41. In this way, the ink supply is made possible for discharging ink from the black ink discharge port group of the recording head unit 5. Also, the joint unit 24 on the carriage 4 is fitted with the ink supply port 42 arranged for the C ink retaining unit of the ink tank 9 to make them conductive. In FIG. 6, while the joint unit 24 and ink supply port 42 are shown, the other joint units 22, and 23 arranged on the carriage 4 can also fit with the respective ink retaining units of the ink tank 9 for Y, M, and C use, that is, Y ink retaining unit and M ink retaining unit, in the same manner as above. In this way, each of the ink retaining units of the ink tank 9 and the corresponding discharge port groups of the recording head unit 5 are connected to make ink supply possible.

First Embodiment

Hereinafter, the description will be made of one mode in which monochromatic printings are mainly performed by an ink jet recording apparatus for color use described above.

Figure 7:
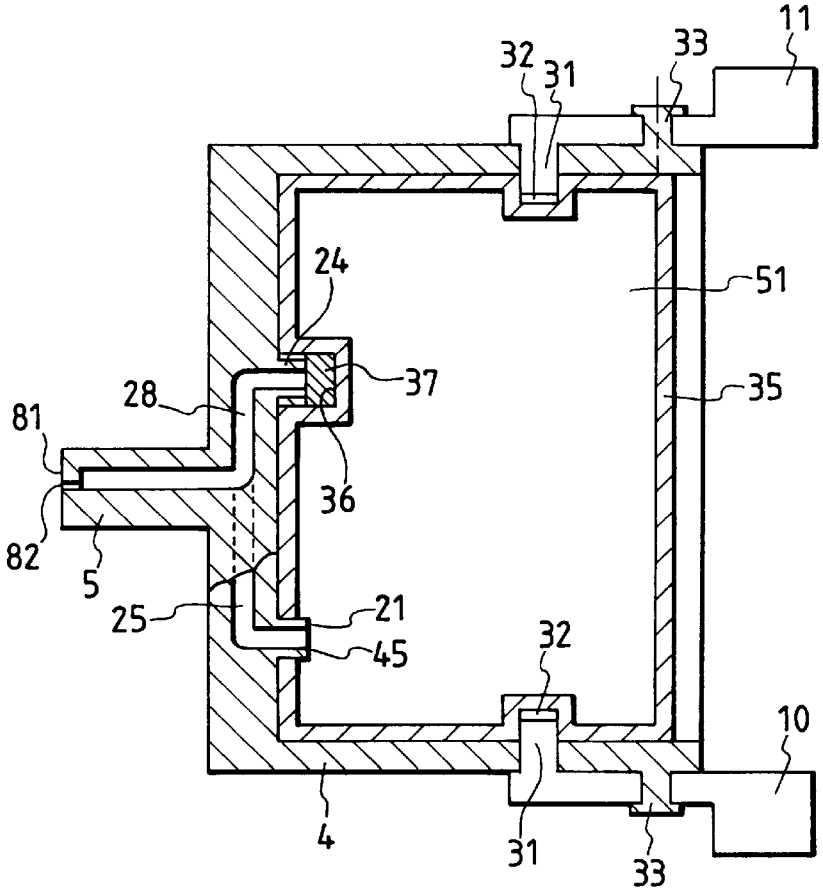
FIG. 7 is a horizontally sectional view which schematically shows an ink tank of a first embodiment of the present invention in a state of being installed.

FIG. 7 is a horizontally sectional view taken along a portion corresponding to the FIG. 6, which schematically illustrates one large ink tank 35 containing one color ink (black ink in the present embodiment) being installed instead of the aforesaid two ink tanks 8 and 9. In FIG. 7, the ink tank 35 is of substantially the same size as that of those two tanks 8 and 9 shown in FIG. 6 put together. On both sides of this tank, elongated grooves 32 and 32 are formed.

This ink tank 35 is locked on the carriage 4 when the lock levers 10 and 11 are rotated counterclockwise around the shafts 33 and 33 as in FIGS. 5A to 5C and FIG. 6. In other words, when the dowels 31 and 31 of the lock levers 10 and 11 on both sides are allowed to engage respectively with the elongated grooves 32 and 32, the lock levers 10 and 11 are operated to rotate counterclockwise and press them in the left-hand direction. In this way, the ink tank 35 shifts in the left-hand direction to position and fix it in a state shown in FIG. 7.

In this respect, an ink absorbent 51 is also arranged in the ink tank 35 as in the ink tanks 8 and 9. Here, a reference numeral 45 designates an ink supply port through which ink retained in the ink tank 35 is led out externally.

In FIG. 7, the one large ink tank 35 of the present embodiment is an ink tank for use of black ink as described earlier. When it is installed, the joint unit 21 for Bk use on the carriage 4 is fitted with the ink supply port 45, and allowed to enter the interior of the ink tank 35. Thus the ink tank 35 and the discharge port group for Bk use of the recording head 5 are communicated with. This completes the required connection.

However, on the carriage 4, there are arranged joint units 22, 23, and 24 for Y, M, and C use in addition to the joint 21 for Bk use. Therefore, in the portions of the ink tank 35 facing (opposite to) these joint units 22, 23, and 24, recesses 36 are formed to allow these joint units to fit in (or enter). Then, in the interior of each recess 36, a rubbery elastic cover 37 is fixed for sealing. It is possible to closely seal the ink paths completely by appropriately selecting the elasticity and configuration of the elastic member 37 corresponding to the inserting amount and shape of the respective joint units.

In this way, the structure is arranged to press the covering member 37 in each recess 36 to the end portion of each of the joint units (Y, M, and C joints) 22, 23, and 24 while the ink tank 35 is locked by means of the lock levers 10 and 11, thus making it possible to seal (air-tightly close) these joint units. As a result, when recording is performed for a long time using only black ink, one large ink tank 35 can be installed in a state represented in FIG. 7. Hence, compared to the case where the ink tank 8 for Bk use is installed as shown in FIG. 6, it is possible to perform more recordings without replacing ink tanks.

Then, with the structure shown in FIG. 7, the joint units 22, 23, and 24 for Y, M, and C use are air-tightly closed by the covering member 37. It is therefore possible to prevent the solvent of remaining ink in the ink paths 26, 27, and 28 from being evaporated so as not to make ink overly viscous and solidified in them. Consequently, when the ink tank 9 for Y, M, and C use is reinstalled for color recording after any monochromatic recording (recording in Bk, for example), there is no possibility that a drawback such as defective ink supply or the like takes place. Also, the intended color recording can be performed reliably.

In the present embodiment, although an elastic member is used for air-tightly closing the joint units, it may be possible to arrange a structure to enable the recess 36 itself to function as a cap when the recess is coupled with each joint unit which is inserted into it. However, there is a possibility that air is pressed into a joint unit when an ink tank is installed. As shown in FIG. 7, therefore, it is most preferable to arrange the recess 36 in a size good enough to form a gap so as to provide an elastic member 37 in the recess, thus making it possible to prevent the air from being sucked in by application of the surface tension of ink on the end portion of the joint unit when being sealed.

With the structure described above, compared to the use of the usual ink tank 8 for Bk use, the essential amount of ink that can be used for printing in black is increased. Thus the frequency of ink tank replacement can be reduced still more.

Second Embodiment

Hereinafter, the description will be made of one mode in which printing is performed mainly in two colors by use of a color ink jet recording apparatus as a second embodiment in accordance with the present invention.

Figure 8:
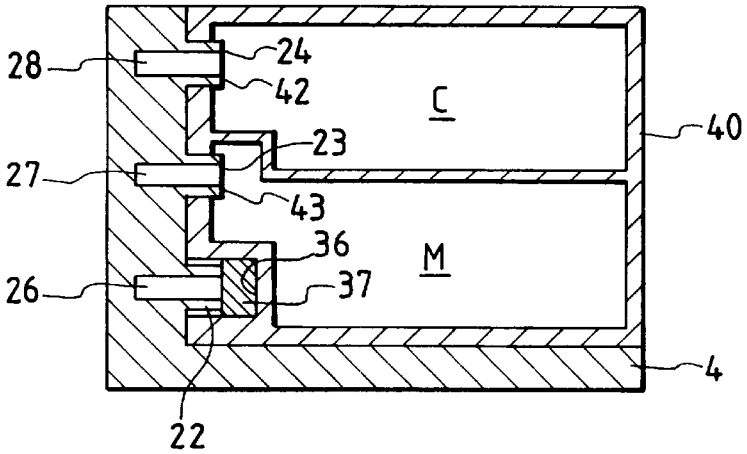
FIG. 8 is a horizontally sectional view which schematically shows an ink tank of a second embodiment of the present invention in a state of being installed.

FIG. 8 is a vertically sectional view including the joint units for Y, M, and C use when the carriage 4 is installed with an ink tank (tank unit) 40, which is still more different, instead of the ink tank 9 for Y, M, and C use represented in FIG. 2 and FIG. 6.

In the present embodiment, the ink tank 40 is of substantially in the same outer configuration and size as those of the ink tank 9 for Y, M, and C use described earlier. However, its interior is divided into two ink chambers (ink tanks) each having almost the same ink retaining capacity. In this respect, although not shown in FIG. 8, ink absorbents are provided for these ink chambers, respectively, as in the embodiment described above.

Then, in the ink chambers, M and C ink are retained, and the M and C ink retaining units are communicated with the intermediate joint unit (M joint unit) 23 and the upper joint unit (C joint unit) 24 on the carriage 4 through the ink supply ports 42 and 43, respectively.

In FIG. 8, the ink tank 40 is provided with a recess 36 in a portion facing the lower joint unit (Y joint unit) 22 arranged on the carriage 4 side. In this recess 36, a covering member 37 formed by a rubbery elastic element is fixed.

In a state that the ink tank 40 is locked by the lock lever 11, the covering member 37 is pressed to the lower joint unit 22 to air-tightly close (seal) the aperture of the ink path 26. Also, when the ink tank 40 is installed, the ink tank 8 for Bk ink use shown in FIG. 2 and FIG. 6 is installed at the same time.

In other words, the structure shown in FIG. 8 makes it possible to connect the ink tank 8 for Bk ink use to the recording head unit 5 through the ink path 25 as in the case represented in FIG. 2 and FIG. 6, while the ink tank 40 is arranged to retain M (magenta) ink in the lower ink tank unit and C (cyan) ink in the upper ink tank unit, and connect them to the recording head unit 5 through the ink paths 23 and 24, and at the same time, air-tightly close and disconnect the aforesaid joint unit 22 and ink path 26. Therefore, it is possible to record in red color by use of M (magenta) ink and C (cyan) ink. Compared to the case where the usual color ink tanks are used as shown in FIG. 6, this arrangement is more effective in terms of the volumetric efficiency when recording is performed only in black and red colors.

In accordance with the embodiment described above, discharge port groups, ink paths, and ink tanks are provided in numbers corresponding to those of the kinds of ink to be used in an ink jet recording apparatus, and while making the ink tanks exchangeable, there are arranged one ink tank having a first size capable of installing all the kinds of ink to be used, and one ink tank having a second size whose capacity is larger than that of the first size for a specific ink, and then, the structure is arranged to allow the ink tank of the second size to air-tightly close the aperture of ink path on the ink tank side for the ink which cannot be installed because of the ink tank of the second size being installed at that time. As a result, it becomes possible to install the ink tank whose capacity is larger for ink of a specific color without making the recording apparatus larger, and further, to prevent ink from being dried in the corresponding ink path of any ink tank which is not installed.

With the structure described above, it is possible, as compared to the usual mode of ink storage, to increase the retaining amount of ink usable for printing in red color to the extent of the Y ink to be retained otherwise as in the first embodiment. Thus the frequency of ink tank replacement is further reduced accordingly.

In this respect, while the description has been made of the case where color ink is retained in an ink tank integrally formed in accordance with the aforesaid embodiment.

However, this is not a prerequisite for the present invention. It may be possible to arrange structure so that an individual tank is prepared for each of Y, M, C, and Bk, and that a large Bk tank is installed while each of the tanks is removed, for example.

Third Embodiment

Hereinafter, the description will be made of one mode in which printing is performed mainly in two colors by use of a color ink jet recording apparatus which retains ink of different colors from those kinds of color ink described above.

For the present embodiment, there is used a usual color ink tank of the same configuration as the first embodiment. What differs is that the combination of ink to be retained in it is red (hereinafter referred to as R), green (referred to as G), and blue (as B) in place of color ink of Y, M and C. The arrangement thereof is R, G, and B from the lower side of the color ink tank in that order corresponding to the one shown in FIG. 2. Also, the locking mechanism of the ink tank is the same as the one used previously.

Figure 9A:
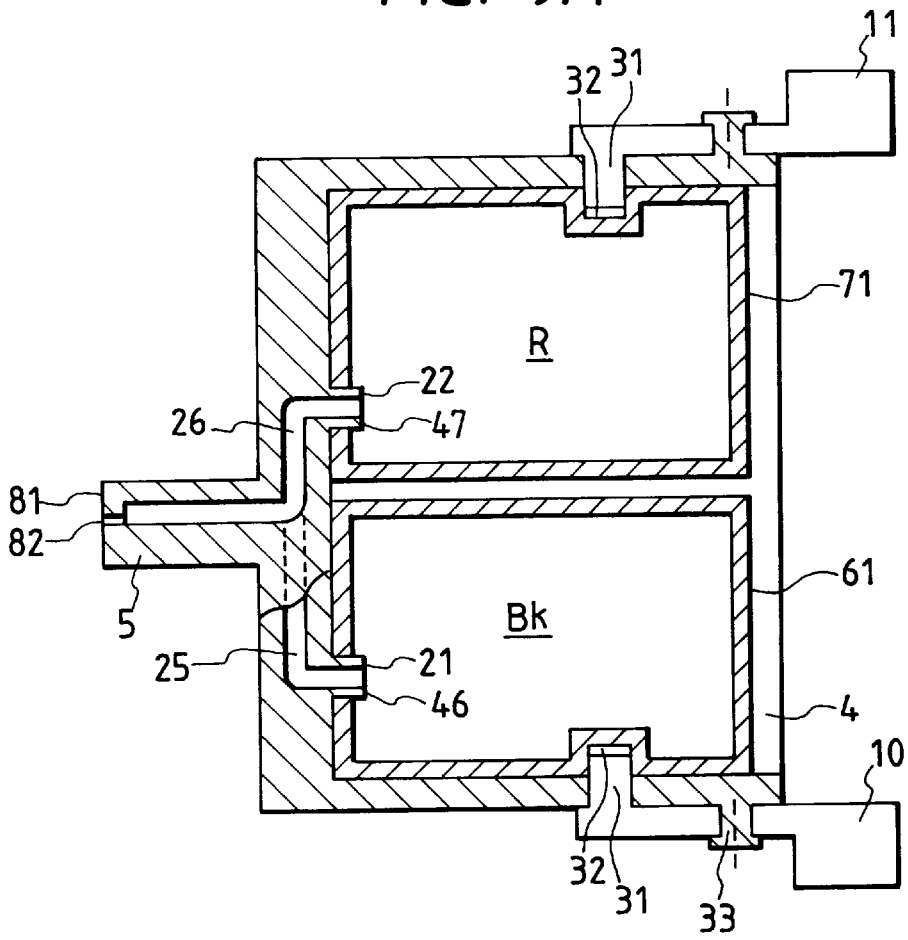
FIGS. 9A and 9B are horizontally sectional views which schematically show an ink tank of a third embodiment of the present invention in a state of being installed.
Figure 9B:
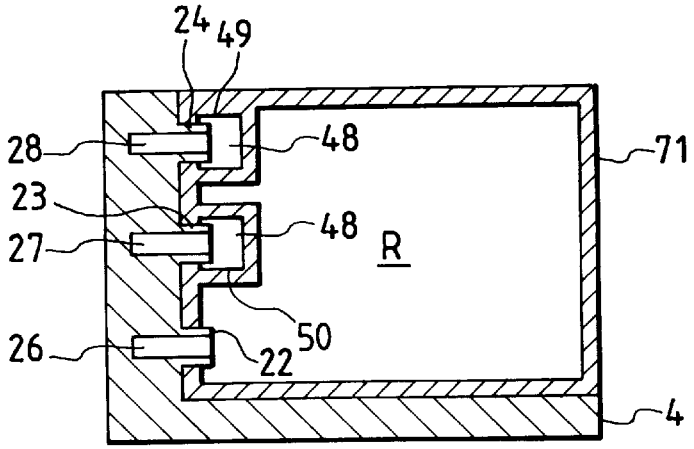

Also, for the tank having a larger capacity which is used for printing in two colors as in the second embodiment, the mode is adopted as illustrated in conjunction with FIGS. 9A and 9B. In the present embodiment, too, black and red are selected for printing in two colors as in the second embodiment, but R, G, and B inks are retained in the color ink tanks which are usually installed for color printing. Therefore, an ink tank 71 is installed to retain only R for printing in red. Here, however, there is no need for C ink and M ink to be mixed as in the second embodiment to print in red. Therefore, the ratio in which the ink tank 8 and ink tank 9 occupy in the installation space can be arranged to almost equally applicable to the installation of the Bk and R ink tanks.

Here, FIG. 9A is a horizontally sectional view which shows a state where the Bk ink tank 61 and R ink tank 71 are installed on the carriage 4 as in FIG. 6. Also, FIG. 9B is a cross-sectional view of the R ink tank on the carriage 4 taken to include ink tank joint units 22, 23, and 24.

In the present embodiment, too, it is possible to supply ink to the head unit by installing the Bk ink tank 61 and R ink tank 71 by means of the locking mechanism, thus allowing the joint units 21 and 22 to be connected with the Bk ink supply port 46 and R ink supply port 47 on the ink tank side.

Then, for the ink tank 71 for R ink use, recesses 50 and 49 are arranged in positions facing the joint units 23 and 24. The apertures of the joint unit 23 and 24 are air-tightly closed against the outside air by arranging an elastic member 48 for each of the recesses, respectively.

With the structure described above, the essential amount of ink storage can be increased more than that of the second embodiment described earlier, hence making it possible to further reduce the frequency of ink tank replacement.

The Other Embodiments

Figure 10A:
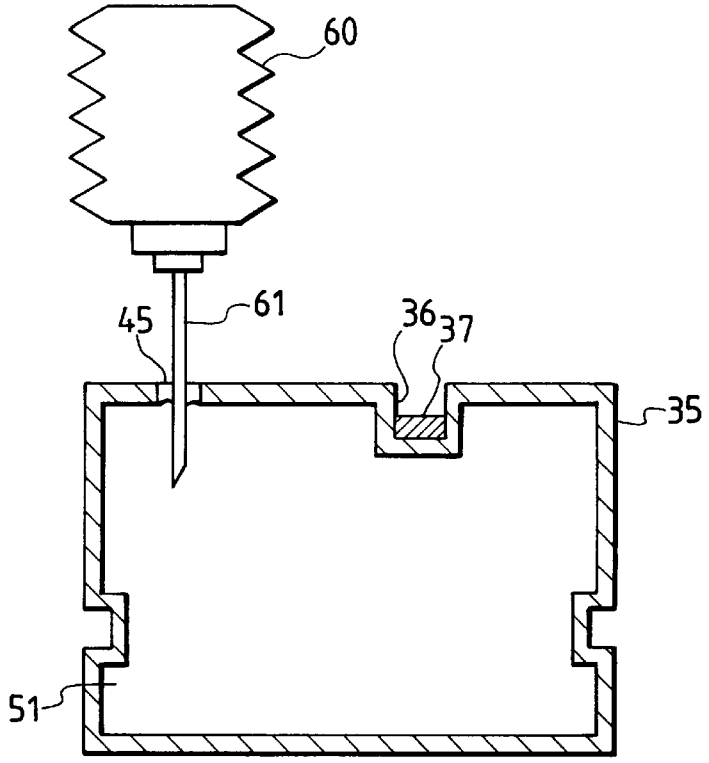
FIGS. 10A and 10B are views which schematically illustrate the ink filling of an ink tank in accordance with the present invention.
Figure 10B:
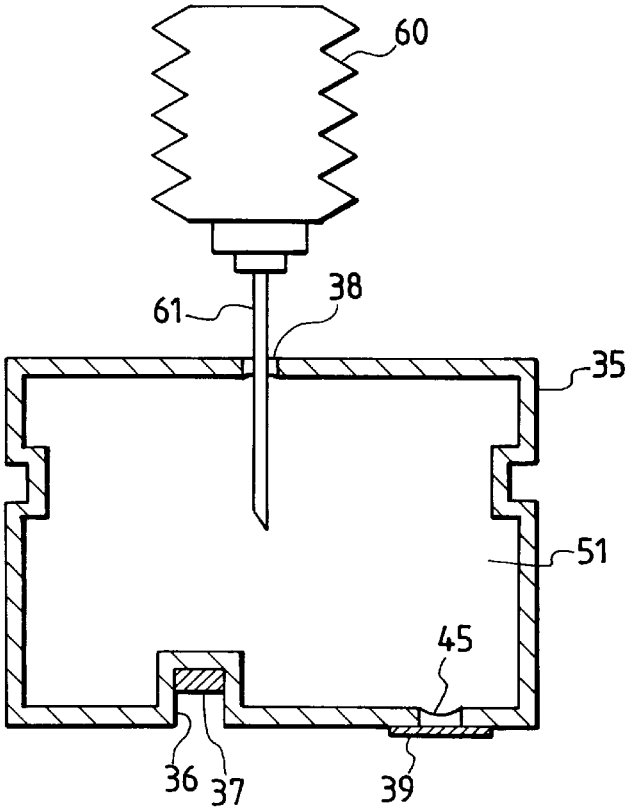

FIGS. 10A and 10B illustrate a method of filling ink to each of the ink tanks described above. The description will be made using the ink tank 35, which is described in the first embodiment, as an example of an ink tank to fill ink in. An ink filling device comprises a bellows tank 60 serving dually as an ink retaining unit and ink pressing unit, and a connecting needle 61 for conducting ink in the tank 60 into the ink tank 35.

FIGS. 10A and 10B illustrate the method of filling ink. FIG. 10A shows a method of injecting ink in such a manner that the connecting needle 61 is inserted into an ink absorbent 51 in the ink tank 35 through the ink supply port 45 provided for the ink tank 35 described above, and then, the bellows tank 60 is deformed to reduce its inner volume. Also, FIG. 10B represents a case where a method of injecting ink by giving pressure is adopted in such a manner that an aperture 38 for filling ink is formed by known means in an arbitrary position on the ink tank 35 described above, and then, the connecting needle 61 is inserted through this aperture 38 for filling ink. If ink is filled while the ink supply port 45 is placed downward in the gravitational direction as shown in FIG. 10B, it is desirable to seal it with a sealing member 39 or the like.

Also, for the kinds of ink provided for an ink jet recording apparatus, it is possible to adopt a mode classified not only by difference of color, but also, by difference of density of ink. Therefore, in an ink jet recording apparatus capable of retaining plural kinds of ink for effectuating a tonal expression by use of plural kind of ink having different densities, the present invention is applicable in the same manner if it is desired to use a lesser number of recording colors than the number of recording colors which is usually provided for such ink jet apparatus. Then the same effects can be obtained as described above.

For example, since no lower-density ink is used for recording only sentences, an arrangement should be made to allow an ink tank of large capacity to be used for ink of the highest density.

In this respect, while the description has been made in each of the aforesaid embodiments only by exemplifying the serial recording method in which recording means (recording head) is caused to travel in the main scanning direction, the present invention is also applicable to the line recording method in which recording is performed only by subscanning with a line recording head having a length to cover entirely or partly the width of a recording material if only the ink tank capable of retaining plural kinds of ink is arranged individually or detachably mountable. In this case, too, the same effects are obtainable.

To realize such a line recording head, it may be possible to adopt either a structure where such a length can be satisfied by combining a plurality of recording heads or a structure arranged by one recording head which is integrally formed.

Also, in this respect, the present invention is applicable to recording means (recording head) which uses piezoelectric elements or other electromechanical transducing elements, for example, as far as an ink jet recording apparatus is employed. Of these recording means, however, it is possible, particularly, for the present invention to demonstrate excellent effects using an ink jet recording apparatus which is provided with recording means of a type which discharges ink by utilizing thermal energy as described earlier, because, with a method of the kind, it is possible to attain a highly densified recording in a higher precision.

With regard to the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system as well. Particularly, however, the method is suitable for the on-demand type because the principle is such that at least one driving signal, which provides a rapid temperature rise beyond a departure from nucleation boiling point in response to recording information, is applicable to an electro-thermal transducing element disposed on a liquid (ink) retaining sheet or liquid path whereby to cause the electrothermal transducing element to generate thermal energy to create film boiling on the thermoactive portion of recording head, thus effectively leading to the resultant formation of a bubble in the recording liquid (ink) one to one in response to each of the driving signals.

By the development and contraction of the bubble, the liquid (ink) is discharged through each discharging port to form at least one droplet. The driving signal is more preferably in the form of pulses because the development and contraction of the bubble can be effectuated instantaneously, and, therefore, the liquid (ink) is discharged with particularly quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

Also, the structure of the recording head may be as shown in each of the above-mentioned specifications wherein the structure is arranged to combine the discharging ports, liquid paths, and the electrothermal transducing elements (linear type liquid paths or right-angled liquid paths). Besides, the structure such as disclosed in the specifications of U.S. Pat. Nos. 4,558,333 and 4,459,600 wherein the thermal activation portions are arranged in a curved area is also included in the present invention.

In addition, the present invention is effectively applicable to the structure disclosed in Japanese Patent Application Laid-Open No. 59-123670 wherein a common slit is used as the discharge ports for plural electrothermal transducing elements, and to the structure disclosed in Japanese Patent Application Laid-Open No. 59-138461 wherein an aperture for absorbing pressure wave of the thermal energy is formed corresponding to the discharge ports. In other words, irrespective of the modes of recording head, the present invention makes it possible to perform printing reliably and effectively by adopting the ink retaining mode which is suitable for the intended recording.

Also, for the present invention, it is preferable to additionally provide a recording head with recovery means and preliminarily auxiliary means as constituents of the recording apparatus because these additional means will contribute to making the effectiveness of the present invention more stabilized. To name them specifically, these are capping means, cleaning means, and suction recovery means with respect to the recording head described earlier, and also, recovery means of a compression type, preheating means such as electrothermal transducing elements or heating elements other than such transducing elements or the combination of those types of elements, and the adoption of a predischarge mode which performs discharges other than the regular discharges. This mode is also effective in executing a stabilized recording.

Further, as the mode of the ink jet recording apparatus in accordance with the present invention, it may be possible to adopt a copying apparatus combined with a reader, in addition to the image output terminal which is integrally or independently provided for a computer, or other information processing apparatus, and moreover, it may be possible to adopt a mode of a facsimile apparatus having functions of transmission and reception.

What is claimed is:

1. An ink tank for supplying ink to a recording means for recording in an ink jet recording apparatus, said apparatus having a plurality of ink paths connected to said recording means and said recording means effecting recording by discharging a given number of plural kinds of ink, said ink tank comprising:

ink retaining units for kinds of ink fewer in number than said given number; and sealing means for sealing those of said plurality of ink paths in excess of said fewer number.

2. An ink tank according to claim 1, wherein said sealing means is provided at a recess portion provided on an outer surface of said ink tank.

3. An ink tank according to claim 2, wherein an elastic member is arranged in said recess portion.

4. An ink refilling system comprising:

an ink tank connected to plural ink paths, the plural ink paths for supplying ink to recording means for recording in an ink jet recording apparatus, the recording means effecting recording by discharging plural kinds of ink of a given number, said ink tank having ink retaining units for kinds of ink fewer in number than said given number and having sealing means for sealing those of said plural ink paths in excess of said given number; and an ink refilling device for refilling ink into at least one of said ink retaining units.

5. An ink refilling system according to claim 4, wherein said ink refilling device includes induction means for inducing ink into said at least one ink retaining unit, wherein said ink tank includes an ink supply port corresponding to said at least one ink retaining unit, and wherein said ink induction means induces ink to said ink retaining unit through said ink supply port.

6. An ink refilling system according to claim 4, wherein said ink refilling device includes induction means for inducing ink into said at least one ink retaining unit, wherein said ink tank includes an ink refilling aperture corresponding to said at least one ink retaining unit, and wherein said ink induction means induces into to said ink retaining unit through said ink refilling aperture.

7. An ink jet recording apparatus for recording by discharging ink to a recording medium, said apparatus comprising:

a recording device for recording on the recording medium, said recording device having a first group of ink discharge ports and a second group of ink discharge ports, and having a mounting portion for separately mounting at least first and second different configurations of ink tanks, the first configuration including a first ink tank for supply of ink to said first group of ink discharge ports and a second ink tank for supply of ink to said second group of ink discharge ports, and the second configuration including a third ink tank for supply of ink to said first group of ink discharge ports, said third ink tank being different from said first ink tank, wherein said third ink tank includes prohibiting means for prohibiting a supply of ink to said second group of ink discharge ports.

8. An ink jet recording apparatus according to claim 7, wherein said prohibiting means is provided at a recess portion provided on said third ink tank.

9. An ink jet recording apparatus according to claim 8, wherein an elastic member is arranged in said recess portion.

10. An ink jet recording apparatus according to claim 7, wherein a volume of an ink containing portion of said third ink tank is larger than that of an ink containing portion of said first ink tank.

11. An ink jet recording apparatus according to claim 7, wherein said recording device is provided with electrothermal transducing elements for generating thermal energy utilized in discharging the ink from said first and second groups of discharge ports.

12. An ink jet recording apparatus according to claim 11, wherein ink is dischargeable from said first and second groups of discharge ports by utilizing film boiling created in the ink by application of the thermal energy generated by said electrothermal transducing elements.

13. An ink jet recording system using recording means for recording by discharging ink through first and second groups of ink discharge ports to a recording medium, said ink jet recording system comprising:

a first ink tank, a second ink tank, and a third ink tank different from said first ink tank, wherein said recording means is constructed to separately mount thereon at least first and second different configurations of ink tanks, the first configuration including said first ink tank for supply of ink to said first group of ink discharge ports and said second ink tank for supply of ink to said second group of ink discharge ports, and said second configuration including said third ink tank for supply of ink to said first group of ink discharge ports, said third ink tank prohibiting a supply of ink to said second group of ink discharge ports.

14. An ink jet recording system for recording on a recording medium, said ink jet recording system comprising:

a recording device for recording by discharging ink therethrough to the recording medium, said recording device having a first group of ink discharge ports and a second group of ink discharge ports;

wherein said recording device is constructed to separately mount thereon at least first and second different configurations of ink tanks, the first configuration including a first ink tank for supply of ink to said first group of ink discharge ports and a second ink tank for supply of ink to said second group of ink jet ports, and said second configuration including a third ink tank for supply of ink to said first group of ink discharge ports, said third ink tank being different from said first ink tank, and said third ink tank prohibiting a supply of ink to said second group of ink discharge ports.

15. An ink jet recording system for recording on a recording medium, said ink jet recording system comprising:

recording means for recording by discharging ink therethrough to the recording medium, said recording means having a first group of ink discharge ports and a second group of ink discharge ports; and a first ink tank, a second ink tank, and a third ink tank different from said first ink tank, wherein said recording means is constructed to separately mount thereon at least first and second different configurations of ink tanks, the first configuration including said first ink tank for supply of ink to said first group of ink discharge ports and said second ink tank for supply of ink to said second group of ink discharge ports, and said second configuration including said third ink tank for supply of ink to said first group of ink discharge ports, said third ink tank prohibiting a supply of ink to said second group of ink discharge ports.

16. An ink jet recording system according to claim 15, wherein said third ink tank has a capacity for containing ink which is larger than that of said first ink tank.

17. An ink jet recording system according to claim 15, wherein said third ink tank has an external shape which is different from that of said first ink tank.

18. An ink jet recording system according to claim 15, wherein said first group of ink discharge ports and said second group of ink discharge ports discharge inks of different kinds.

19. An ink jet recording system according to claim 15, wherein said first group of ink discharge ports and said second group of ink discharge ports are integrally arranged.

* * * * *

UNITED STATES PATENT AND TRADEMARK OFFICE

CERTIFICATE OF CORRECTION

PATENT NO. : 6,081,284

DATED : June 27, 2000

INVENTOR(S) : Yoichi Tosaka and Kenichiro Hashimoto

It is certified that error appears in the above-identified patent and that said Letters Patent is hereby corrected as shown below:

IN THE ABSTRACT

Line 11, change "comprise" to --comprises--.

COLUMN 3

Line 52, change "comprise" to --comprises--.

COLUMN 7

Line 35, change "illustrates" to --illustrate--.

COLUMN 14

Line 37, change "into to" to --ink into--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*